US007937776B1

(12) United States Patent
Anderson

(10) Patent No.: US 7,937,776 B1
(45) Date of Patent: May 10, 2011

(54) SHORT BELT FOR PANTS

(76) Inventor: Shannon L. Anderson, Rocklin, CA (US)

( * ) Notice: Subject to any disclaimer, the term of this patent is extended or adjusted under 35 U.S.C. 154(b) by 782 days.

(21) Appl. No.: 11/811,854

(22) Filed: Jun. 11, 2007

(51) Int. Cl.
*A41F 9/02* (2006.01)

(52) U.S. Cl. ..... 2/338; 2/237

(58) Field of Classification Search ..... 2/237, 309, 2/311, 312, 321, 220, 221, 219, 235, 236, 2/338, 339, 300
See application file for complete search history.

(56) References Cited

U.S. PATENT DOCUMENTS

| | | | | |
|---|---|---|---|---|
| 1,331,457 | A | 2/1920 | Elliott | |
| 1,345,917 | A | 7/1920 | Fitzgerald | |
| 1,464,966 | A | 8/1923 | Bears | |
| 1,607,156 | A | 11/1926 | Godshaw | |
| 1,753,657 | A | 4/1930 | Kaplan | |
| 2,113,646 | A | 4/1938 | Capuano | |
| 2,287,899 | A | 6/1942 | Nix | |
| 2,977,601 | A | 4/1961 | Winston | |
| 4,800,594 | A | 1/1989 | Young | |
| 4,858,249 | A * | 8/1989 | Stewart | 2/305 |
| 5,566,397 | A | 10/1996 | Scott | |
| 5,575,011 | A * | 11/1996 | Allen | 2/227 |
| 5,898,947 | A * | 5/1999 | Page | 2/237 |
| 6,026,515 | A * | 2/2000 | Nielson et al. | 2/244 |
| 6,085,356 | A * | 7/2000 | Redmond, Sr. | 2/237 |
| 6,098,202 | A * | 8/2000 | Peck | 2/244 |
| D435,145 | S * | 12/2000 | Lindsey | D29/100 |
| 6,163,937 | A * | 12/2000 | McKinnis et al. | 24/302 |
| 6,219,848 | B1 * | 4/2001 | Russell | 2/221 |
| 6,381,752 | B1 * | 5/2002 | Cartelli | 2/86 |
| 6,671,888 | B2 * | 1/2004 | Wallace | 2/237 |
| 7,155,784 | B1 * | 1/2007 | DeGroot | 24/578.1 |
| D560,328 | S * | 1/2008 | Noonan | D2/627 |
| 7,410,407 | B2 * | 8/2008 | Krammel | 450/58 |
| 2009/0007316 | A1 * | 1/2009 | Escudero Munoz | 2/300 |
| 2009/0139014 | A1 * | 6/2009 | Trochlil-Crist | 2/338 |

* cited by examiner

*Primary Examiner* — Alissa L Hoey
(74) *Attorney, Agent, or Firm* — Heisler & Associates

(57) ABSTRACT

The short belt has a free end and fixed end with a buckle or other fastener adjacent the fixed end. The belt is formed of an elongate body of flexible material which can be secured to the buckle or other fastener to cause the belt to have a fixed circumference less than a diameter of a garment with which the belt is to be used. The short belt is routed through at least two loops on a garment with the short belt first being routed under the loops and then being routed over the loops and fastened into a circuit utilizing the buckle or other fastener. The circuit thus passes both under the loops and over the loops with a single circuit having a circumference less than a circumference of the garment adjacent the loops on the garment.

3 Claims, 3 Drawing Sheets

SHORT BELT FOR PANTS

FIELD OF THE INVENTION

The following invention relates to belts for clothing, and particularly for pants or other clothing having a top hem with belt loops adjacent thereto. More particularly, this invention relates to belts for pants which are shorter than an entire circumference of the pants adjacent the top hem, but rather only join two belt loops together.

BACKGROUND OF THE INVENTION

Belts are will known in the clothing arts, particularly for use girding a waist of an individual to hold various different clothing items tight to the body of the individual. One common use for belts is routing them through a series of belt loops in clothing of a type having such belt loops adjacent to a top hem thereof (or at other locations, such as a waist of a dress, where a belt is to be accommodated). For instance, pants are often configured with a top hem configured to surround a waist of the wearer. A fly is often formed in the top hem to allow the top hem to be altered in diameter while an individual is putting on the pants. Similarly, skirts are sometimes formed with a top hem and fly in a manner similar to pants. Such pants or other similar clothing often include belt loops adjacent the top hem to receive a belt. The belt is routed through each of the belt loops and passes entirely around a waist of the user and is fastened back to itself. When the belt is tightened, it holds the top hem of the garment tight to the wearer, keeping the garment securely in place.

One less common type of belt that is known in the prior art does not pass entirely around the waist of a wearer, but rather only joins portions of the top hem together. For instance, U.S. Pat. No. 5,566,397 to Scott; U.S. Pat. No. 4,800,594 to Young; and U.S. Pat. No. 1,607,156 to Godshaw each teach belts for pants that interact with belt loops on the pants, but which do not go entirely around the waist of the pants utilizing all of the belt loops. Rather, these shortened belts wrap around two belt loops separately and join back to the belt. The belt also separately extends between those two belt loops, joining them together in an adjustable fashion.

These shortened belts taught by Scott, Young and Godshaw each extend around the belt loop and then attach back to the belt before extending to form a complete circuit. In essence, the belts have at least two adjustable circuits with each of the circuits themselves wrapping around belt loops on the pants. Such an arrangement enhances a complexity of such a shortened belt and enhances the difficulty with which such a shortened belt can be attached and detached from the various different belt loops of the pants. Hence, such shortened belt configurations are typically provided in a permanently attached fashion to the pants, rather than being removably attachable so that the belt can be used on various different clothing items. Also, the fasteners utilized are not as secure as is required for many adult users, or for particularly large or heavy garments. Accordingly, a need exists for a short belt which can be easily routed through two adjacent belt loops and close back to itself to form a single circuit and hold the two adjacent belt loops closely to each other to tighten the pants in a simple and secure fashion.

SUMMARY OF THE INVENTION

With this invention a short belt is provided which is shorter than a circumference of a garment with which the short belt is to be used. For instance, the short belt might have an overall length of twelve inches or less and yet to be used by an adult. The short belt includes a free end and a fixed end with the fixed end including a fastener thereon such as a buckle. The fastener can removably grasp a portion of the belt between the fixed end and the free end, so that the belt can be selectively formed into a circuit of varying diameter.

In utilizing this short belt, the user first routes the elongate body portion of the belt through at least two of the belt loops, but less than all of the belt loops. Next, and unique to this invention, rather than continuing to wrap the belt around the wearer and utilizing all of the belt loops, instead the belt is routed away from the wearer to form a circle back to the fastener and adjacent outside surfaces of the belt loops. Once coupled to the fastener, the short belt forms a single circuit which has at least two belt loops passing therethrough, with a portion of the elongate body of the belt passing under the belt loops and a portion of the elongate body of the belt passing over the belt loops.

The belt is sufficiently tightened before closing the buckle to draw the two belt loops within the circuit toward each other. This causes an overall tightening effect for the top hem of the pants or other garment, holding the pants or other garment securely upon the wearer. While the short belt is most typically routed through the two belt loops closest to the fly in the pants or other garment, the short belt could alternatively be routed to two adjacent belt loops on either side of the garment, or a rear of the garment. It is also conceivably that multiple such short belts could be utilized simultaneously on different sets of belt loops on the garment. Also, it is conceivable that the short belt can be routed through two belt loops which are not directly adjacent each other, or that the short belt could be routed through more than two belt loops, but less than all of the belt loops of the garment.

OBJECTS OF THE INVENTION

Accordingly, a primary object of the present invention is to provide a belt for securely holding pants or similar garments with a top hem and belt loops to a wearer.

Another object of the present invention is to provide a belt which is compact in form and easy to attach and adjust to belt loops of pants or other garments.

Another object of the present invention is to provide a short belt and pants combination which does not require that the belt pass entirely around a waist of the wearer.

Another object of the present invention is to provide a belt for joining two or more belt loops together which is shorter than a circumference of garments upon which the belt loops are located.

Another object of the present invention is to provide a method for routing a belt through belt loops that is easy to perform and results in a belt of effective yet unique routing for an attractive visual appearance.

Other further objects of the present invention will become apparent from a careful reading of the included drawing figures, the claims and detailed description of the invention.

DESCRIPTION OF THE PREFERRED EMBODIMENT

Figure 1:
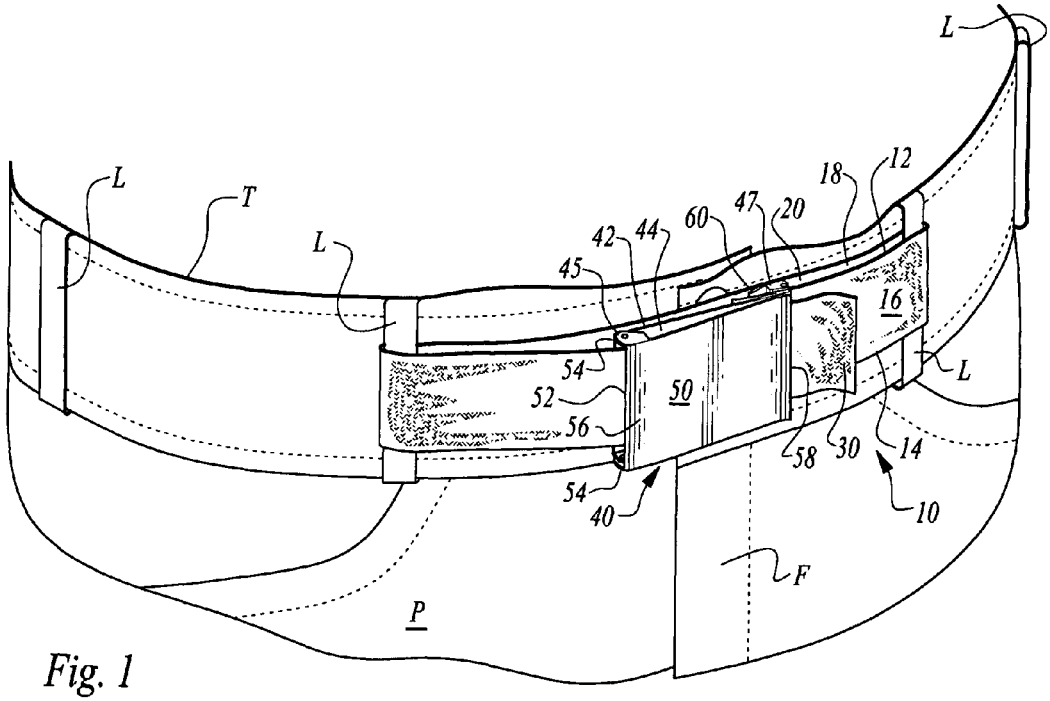
FIG. 1 is a perspective view of a top hem of pants with a short belt according to this invention joining two belt loops adjacent a fly of the patents together.

Referring to the drawings, wherein like reference numerals represent like parts throughout the various drawing figures, reference numeral 10 is directed to a short belt for use in holding at least two loops L of pants P or similar garments together. The short belt 10 is used according to a method involving routing the short belt 10 through at least two loops L by first going under the belt loops L and then going over a top of the same belt loops L and then being coupled to itself, such as with a buckle 40, to form the short belt 10 into a circuit. This circuit has a portion beneath the belt loops L and a portion above the loops L.

Figure 2:
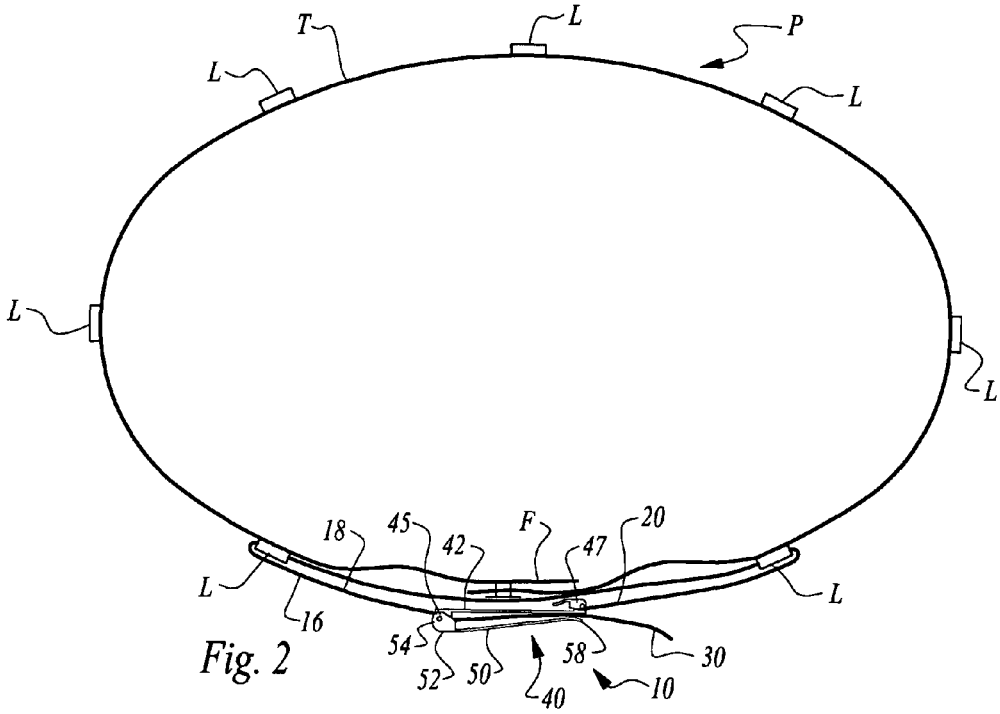
FIG. 2 is a top plan view of that which is shown in FIG. 1.
Figure 5:
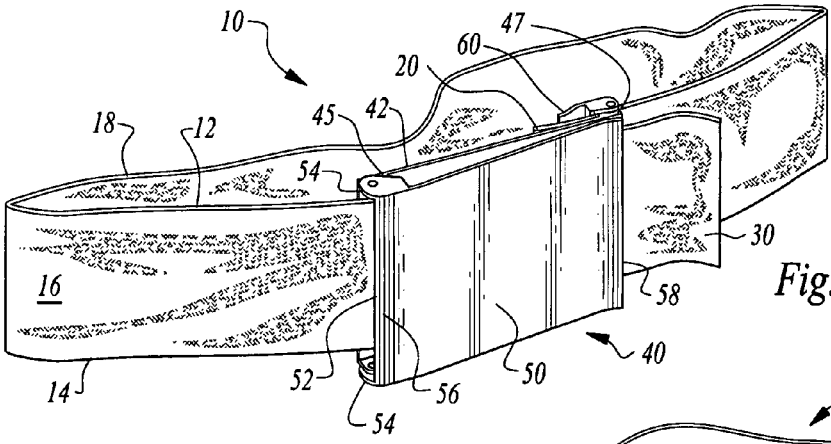
FIG. 5 is a perspective view of the short belt of this invention shown alone.
Figure 8:
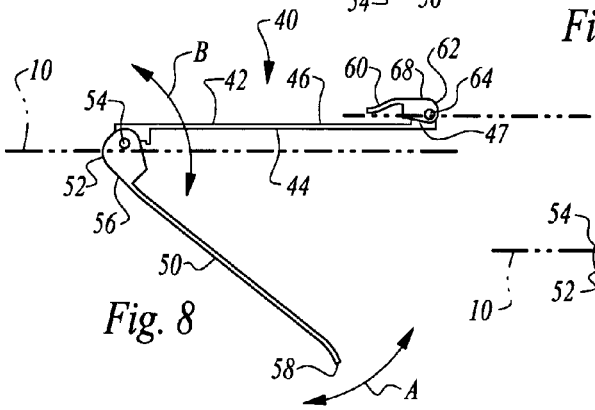
FIG. 8 is a top plan view of a buckle providing a preferred form of fastener for the belt of this invention and with an elongate body of the belt shown in dashed lines, with the buckle depicted in an open configuration.

In essence, and with particular reference to FIGS. 1, 2 and 5, basic details of the short belt 10 of this invention are described according to the preferred embodiment. The belt 10 is formed of an elongate flexible body extending from a fixed end 20 to a free end 30. A buckle 40 provides a preferred form of fastener adjacent the fixed end 20. The buckle 40 or other fastener is adapted to be removably coupled to a portion of the elongate body of the short belt 10 between the fixed end 20 and free end 30. The buckle 40 of this preferred embodiment includes a base plate 42 with a clamp plate 50 pivotably attached thereto. The clamp plate 50 can be rotated (along arrow A of FIG. 8) to releasably secure the elongate body of the short belt 10 to the base plate 42 of the buckle 40.

The buckle 40 also preferably includes an anchor plate 60 which pivotably attaches to the base plate 42 of the buckle 40 on a rear 46 of the base plate 42. This anchor plate 60 secures the fixed end 20 of the elongate body of the short belt 10 to the base plate 42. Typically, the anchor plate 60 is left in an attached form holding the fixed end 20 to the base plate 42, and would only be adjusted if the elongate body of the short belt 10 were to be replaced. In contrast, the clamp plate 50 is pivoted in the ordinary course of removably attaching and detaching the buckle 40 to portions of the elongate body of the short belt 10 between the fixed end 20 and the free end 30, to fix the short belt 10 at a single circumferential length.

Figure 6:
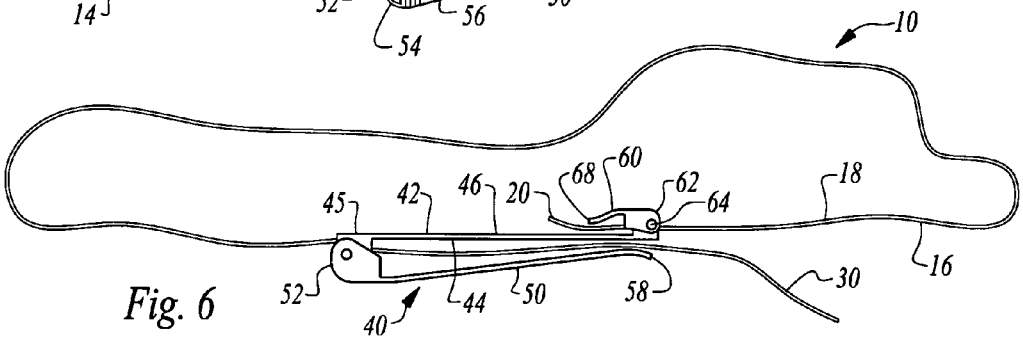
FIG. 6 is a top plan view of that which is shown in FIG. 5.
Figure 7:
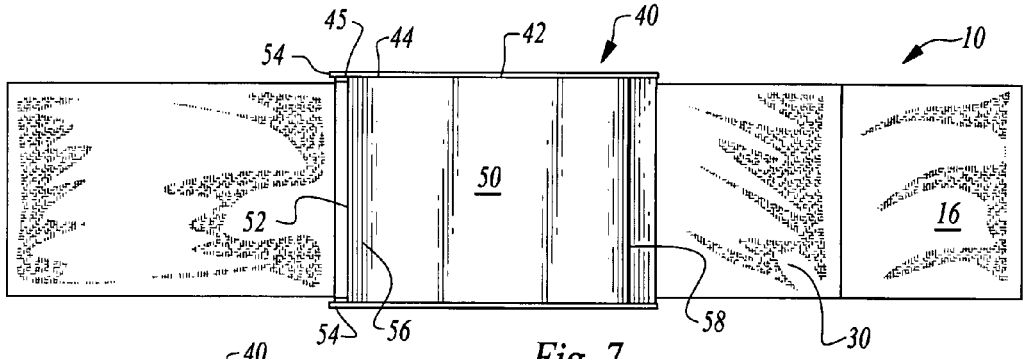
FIG. 7 is a front elevation view of that which is shown in FIG. 5.

More specifically, and with particular reference to FIGS. 5 and 6, details of the elongate body forming the short belt 10 are described. The elongate body is preferably formed of a flexible thin fabric geometrically defined between a top edge 12 and a bottom edge 14 which are preferably parallel to each other and extend from the fixed end 20 to the free end 30. The elongate body includes a front side 16 opposite a rear side 18 defining a thickness of the elongate body of the short belt 10.

Fabric forming the elongate body of the short belt 10 could be a canvas-like material, woven cotton, wool, polyester, or some blend of the these or other fabric materials often used in garment manufacture. The elongate body could also conceivably be formed of leather, imitation leather, or any other material from which garments or belts are typically manufactured.

The elongate body is highly flexible, but substantially inelastic. Thus, the elongate body can be easily routed through various different loops L in pants P. Once the elongate body of the short belt 10 has been captured to the buckle 40, a circumference of the short belt 10 does not significantly change due to forces applied to the short belt 10.

With particular reference to FIGS. 5-9, details of the buckle 40, defining a preferred form of fastener for the short belt 10, are described. While the buckle 40 is illustrated, other forms of buckles or other fasteners could be utilized, provided that the basic function of removably attaching the fixed end 20 of the short belt to a portion of the short belt 10 between the fixed end 20 and the free end 30 is provided. With the buckle 40 of this invention a simple clamp style buckle is provided which causes the belt 10 to be essentially infinitely variable in circumferential length.

The buckle 40 includes a rigid base plate 42 which is preferably thin and substantially rectangular in form. This base plate 42 includes a front 44 opposite a rear 46. A clamp hinge 45 is provided extending forward from the front 44 at a side thereof opposite the fixed end 20 of the elongate body of the short belt 10. A fixed hinge 47 extends rearwardly from the rear 46 of the base plate 42. This fixed end 47 is on a side of the base plate 42 opposite the clamp hinge 45 and adjacent where the fixed end 20 of the elongate body of the short belt 10 is coupled to the buckle 40.

The clamp plate 50 is pivotably attached to the base plate 42 at the clamp hinge 45. The clamp plate 50 is preferably similar in form to the base plate 42 and also similar in size to the base plate 42. The clamp plate 50 has a pivoting edge 52 pivotably attached to the clamp hinge 45. Pins 54 extend from the pivoting edge 52 of the clamp plate 50 to engage each of the clamp hinges 45 at upper and lower edges of the base plate 42. These pins 54 thus act as pintles along a pivoting axis for the clamp plate 50.

Figure 9:
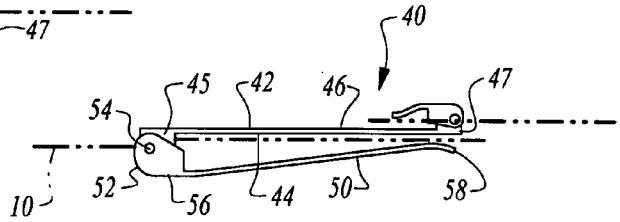
FIG. 9 is a top plan view similar to that which is shown in FIG. 8, but with the buckle transitioned to a closed configuration.

The clamp plate 50 includes a bend 56 adjacent where the pins 54 are located. This bend extends from an upper edge to a lower edge of the clamp plate 50. The clamp plate 50 extends past the bend 56 slightly to a tip 58. This tip 58 preferably has teeth thereon with this tip 58 adapted to engage material forming the elongate body of the short belt 10. When the clamp plate 50 is oriented substantially parallel with the base plate 42, the tip 58 of the clamp plate 50 preferably extends substantially perpendicularly from the pivoting edge 52 of the clamp plate 50 toward the base plate 42. In this way, the tip 58 wedges the elongate body of the short belt 10 between the tip 58 and the base plate 42 when the clamp plate 50 is in its closed position parallel and adjacent to the base plate 42 (FIG. 9).

When the clamp plate 50 is rotated (along arrow A of FIG. 8) the tip 58 is also caused to rotate (along arrow B of FIG. 8) away from the base plate 42. With such rotation, the elongate body of the short belt 10 is released by the tip 58 and the clamp plate 50. The elongate body of the short belt 10 is then free to slide between the clamp plate 50 and the base plate 42 of the buckle 40, such as for adjusting a circumference of the short belt 10.

The anchor plate 60 provides a preferred form of a means to attach the fixed end 20 of the belt 10 to the fastener, such as the buckle 40. Other means could include rivets or other mechanical coupling devices. The anchor plate 60 is preferably somewhat similar in form to the clamp plate 50 except that it is much shorter in a horizontal direction. Also, the anchor plate 60 is preferably formed with tighter tolerances and less of a gap adjacent to the rear 46 of the base plate 42 so that the anchor plate 60 most securely holds the fixed end 20 of the elongate body to the rear 46 of the base plate 42. The anchor plate 60 thus includes a pivoting edge 62 with pins 64 that engage the fixed hinge 47 of the base plate 42. The pins 64 extend vertically up and down and along a pivoting axis for the anchor plate 60. The anchor plate 60 bends adjacent the pivoting edge 62 and then extends to a tip 58 which almost touches the base plate 42 when oriented in a closed position for the anchor plate 60, securely capturing a portion of the fixed end 20 of the elongate body of the short belt 10 adjacent to the rear 46 of the base plate 42. The anchor plate 60 is typically only pivoted during manufacture of the belt 10 and attachment of the fixed end 20 to the buckle 40 or other fastener, or to replace the elongate body of the belt 10.

With particular reference to FIGS. 1-4, details of the use and operation of the short belt 10 of this invention are described according to the preferred embodiment. Initially, the short belt 10 is provided with the buckle 40 or other fastener in an open position so that the elongate body of the short belt 10 is not captured by the buckle 40 or other fastener. The free end 30 of the short belt 10 is then routed through a first belt loop L. The belt loop L to be selected for such free end 30 routing is adjacent to one side of where, on the top hem T of the pants P or other garment, the short belt 10 is to be located. A second loop L is also selected, defining an opposite boundary of where the short belt 10 is to be located. The free end 30 of the short belt 10 is then routed from the first belt loop L to the second belt loop L where the free end 30 is routed under the second belt loop L.

Next, the free end 30 is rotated away from the top hem T and caused to overlie the second belt loop L through which the free end 30 was just routed. The free end 30 is then caused to rotate approximately 180° and be routed back toward the first belt loop L (without passing around the top hem T or the waist of the wearer). Once the free end 30 has been routed approximately halfway back towards the first belt loop L, the free end 30 is routed through the buckle 40 and the buckle 40 is utilized to secure a portion of the short belt 10 between the free end 30 and the fixed end 20 to the buckle 40.

Such securing with the buckle 40 occurs after the free end 30 has been pulled toward the first belt loop L sufficiently to cause a circuit formed by the short belt 10 to be tight between the two belt loops L, so that the two belt loops L are drawn towards each other somewhat. This drawing of the belt loops L toward each other causes the top hem T to be slightly shorter in circumference, aiding in keeping the pants P or other garment securely upon the wearer. When the short belt 10 is to be adjusted, such as when the pants P or other garment are to be removed, the buckle 40 or other fastener is caused to release the elongate body and the free end 30 can be freed from the buckle 40, and the entire short belt 10 removed from the belt loops L.

While the short belt 10 would most typically be placed on a front portion of pants P or other similar garments (i.e. skirts or dresses) the short belt 10 could be located at other portions of the top hem T.

Figure 3:
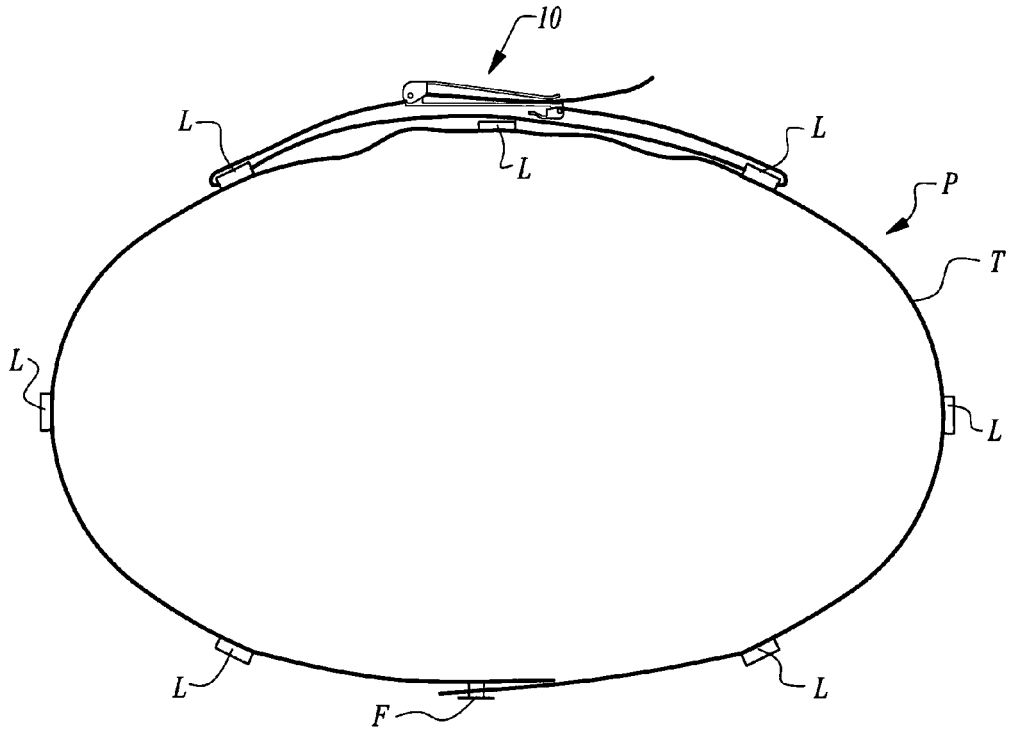
FIG. 3 is a top plan view of an alternative location for the short belt with the short belt located on a rear of the pants.
Figure 4:
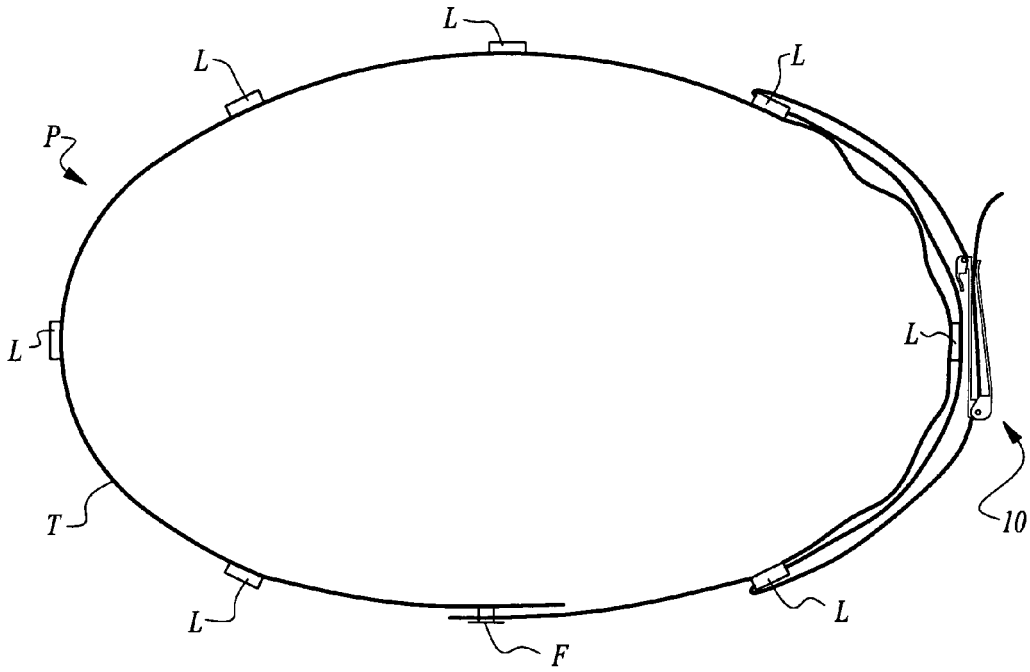
FIG. 4 is a top plan view similar to that which is shown in FIG. 2 but with the short belt shown in an alternative location on a side of the pants.

For instance, and as shown in FIG. 3, the short belt 10 can be routed through two belt loops L on a rear portion of the pants P or other garment and still function to assist in holding the pants P or other garment upon the wearer. Also, the short belt 10 can be routed through loops L on a side of the pants P or other garment (FIG. 4) and still function according to this invention. Thus, it is not strictly necessary that the short belt 10 be routed over the fly F in the top hem T of the pants P or other garment.

While the loops L are generally defined as being along the top hem T, with some garments, such as dresses, the loops L could be provided on a portion of the garment which is not a top hem, but is still a portion of the garment which is generally about a waist of the wearer and where such a top hem T would be if the garment were pants.

The short belt 10 could be configured with a variety of different lengths, but is most preferably shorter than a circumference of the pants P or other garment to which the short belt 10 is to be attached. Most preferably, the short belt 10 has a length of twelve inches from the free end 30 to the fixed end 20, so that belt loops that are five or six inches apart (or closer together) can be effectively utilized with the short belt 10. Short belts 10 of other lengths could also be provided, with the short belt 10 only necessarily being shorter than an overall circumference of the garment. It is also conceivable that the belt 10 could be as long or longer than a circumference of the garment adjacent the belt loops L, in which case the belt 10 would not itself be unique from prior art belts, but would still be utilizable according to the unique method of this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for holding pants or similar clothing tight to a waist of a user, the clothing including a top hem with a plurality of belt loops adjacent the top hem, the method including the steps of:

selecting an elongate belt extending between ends and consisting of a single fastener, the fastener adapted to couple the belt to itself to form a circuit;

first routing the belt through two of the belt loops;

second routing the belt over an outer side of the two belt loops and back toward itself;

coupling the belt to itself through the fastener with the fastener located on an outer side of the two belt loops to cause the belt to form a circuit with part of the circuit passing through the belt loops and part of the circuit adjacent to but outside of the belt loops;

wherein said coupling step includes the step of opening a clamp on the fastener, feeding a portion of the belt through a gap between the clamp and a plate of the fastener adjacent the clamp to which the clamp is pivoted, and closing the clamp to capture a portion of the belt between the clamp and the adjacent plate of the fastener;

tightening the elongate belt by:

grasping a free end of the elongate belt, and applying tension to the free end of elongate belt, and moving the free end of the elongate belt relative to the fastener;

wherein said first routing step includes routing the belt through two adjacent belt loops on clothing having more than two belt loops; and wherein said routing step includes selecting two loops closest to a front of the clothing and routing the belt through the two loops closest to the front of the clothing.

2. A method for holding pants or similar clothing tight to a waist of a user, the clothing including a top hem with a plurality of belt loops adjacent the top hem, the method including the steps of:

selecting an elongate belt extending between ends and consisting of a single fastener, the fastener adapted to couple the belt to itself to form a circuit;

first routing the belt through two of the belt loops;

second routing the belt over an outer side of the two belt loops and back toward itself;

coupling the belt to itself through the fastener with the fastener located on an outer side of the two belt loops to cause the belt to form a circuit with part of the circuit passing through the belt loops and part of the circuit adjacent to but outside of the belt loops;

wherein said coupling step includes the step of opening a clamp on the fastener, feeding a portion of the belt through a gap between the clamp and a plate of the fastener adjacent the clamp to which the clamp is pivoted, and closing the clamp to capture a portion of the belt between the clamp and the adjacent plate of the fastener; and tightening the elongate belt by:

grasping a free end of the elongate belt, and applying tension to the free end of elongate belt, and moving the free end of the elongate belt relative to the fastener;

wherein said routing step includes selecting two loops both on one of said sides of the clothing and routing the belt through the two loops on one of said sides of the clothing.

3. A method for holding pants or similar clothing tight to a waist of a user, the clothing including a top hem with a plurality of belt loops adjacent the top hem, the method including the steps of:

selecting an elongate belt extending between ends and consisting of a single fastener, the fastener adapted to couple the belt to itself to form a circuit;

first routing the belt through two of the belt loops;

second routing the belt over an outer side of the two belt loops and back toward itself;

coupling the belt to itself through the fastener with the fastener located on an outer side of the two belt loops to cause the belt to form a circuit with part of the circuit passing through the belt loops and part of the circuit adjacent to but outside of the belt loops;

wherein said coupling step includes the step of opening a clamp on the fastener, feeding a portion of the belt through a gap between the clamp and a plate of the fastener adjacent the clamp to which the clamp is pivoted, and closing the clamp to capture a portion of the belt between the clamp and the adjacent plate of the fastener;

tightening the elongate belt by:

grasping a free end of the elongate belt, and applying tension to the free end of the elongate belt, and moving the free end of the elongate belt relative to the fastener;

wherein said first routing step includes routing the belt through two adjacent belt loops on clothing having more than two belt loops; and wherein said routing step includes selecting two loops both on a rear of the clothing and routing the belt through the two loops on the rear of the clothing.

* * * * *